US008152448B2

(12) United States Patent
Kawakami et al.

(10) Patent No.: US 8,152,448 B2
(45) Date of Patent: Apr. 10, 2012

(54) STEAM TURBINE HAVING A NOZZLE BOX ARRANGED AT AN UPSTREAM SIDE OF A STEAM PASSAGE THAT DIVIDES A SPACE BETWEEN A ROTOR AND A CASING INTO SPACES THAT ARE SEALED FROM EACH OTHER

(75) Inventors: Hiroshi Kawakami, Kanagawa (JP); Kazutaka Ikeda, Tokyo (JP); Kouichi Kitaguchi, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 849 days.

(21) Appl. No.: 12/195,905

(22) Filed: Aug. 21, 2008

(65) Prior Publication Data

US 2009/0053048 A1 Feb. 26, 2009

(30) Foreign Application Priority Data

Aug. 22, 2007 (JP) ..... 2007-215768

(51) Int. Cl.
*F04D 29/08* (2006.01)

(52) U.S. Cl. ..... 415/111; 415/112; 415/199.4; 415/202

(58) Field of Classification Search ..... 415/112, 415/113, 199.4
See application file for complete search history.

(56) References Cited

U.S. PATENT DOCUMENTS

| | | | | |
|---|---|---|---|---|
| 3,746,463 | A | 7/1973 | Stock et al. | |
| 4,362,464 | A | 12/1982 | Stock | |
| 4,498,301 | A | 2/1985 | Tsubouchi | |
| 4,550,569 | A | 11/1985 | Isa et al. | |
| 4,884,934 | A | 12/1989 | Ikeda et al. | |
| 5,215,436 | A | 6/1993 | Puzyrewski | |
| 5,392,513 | A | 2/1995 | Mazzola et al. | |
| 5,411,365 | A | 5/1995 | Mazzola et al. | |
| 6,341,937 | B1 * | 1/2002 | Magoshi et al. | 415/108 |
| 2009/0053048 | A1 | 2/2009 | Kawakami et al. | |
| 2009/0068001 | A1 | 3/2009 | Kawakami | |

FOREIGN PATENT DOCUMENTS

| | | | |
|---|---|---|---|
| DE | 846 696 | C | 8/1952 |
| DE | 759 486 | C | 3/1953 |
| DE | 10 04 202 | B | 3/1957 |

(Continued)

OTHER PUBLICATIONS

H. Kawakami, U.S. PTO Office Action, U.S. Appl. No. 12/195,897, dated Jun. 13, 2011, 9 pages.

(Continued)

*Primary Examiner* — Stephen W Smoot
(74) *Attorney, Agent, or Firm* — Foley & Lardner LLP

(57) ABSTRACT

A steam turbine has a stationary section, a turbine rotor, nozzle diaphragms, a steam passage section, a nozzle box and a sealing. The stationary section includes a casing. The turbine rotor includes moving blade stages. Each of the moving blade stages has turbine moving blades. Each of the nozzle diaphragms has turbine nozzles. The moving blade portions and the turbine nozzle portions constitute the steam passage. The nozzle box is held by the stationary section and arranged at an upstream side of the steam passage coaxially with the turbine rotor. The sealing divides a space between the turbine rotor and the casing into a first space provided at an inner side and a second space provided at an outer side of the nozzle box.

4 Claims, 8 Drawing Sheets

FOREIGN PATENT DOCUMENTS

| | | | |
|---|---|---|---|
| EP | 1 094 201 | A1 | 4/2001 |
| EP | 1 096 110 | A1 | 5/2001 |
| EP | 1 098 070 | A1 | 5/2001 |
| GB | 790 654 | A | 2/1958 |
| GB | 1 010 300 | A | 11/1965 |
| GB | 1 073 415 | A | 6/1967 |
| JP | 51-065102 | U | 5/1976 |
| JP | 56-109602 | U | 8/1981 |
| JP | 59-206602 | A | 11/1984 |
| JP | 61-085502 | A | 5/1986 |
| JP | 61-138804 | A | 6/1986 |
| JP | 3-066484 | B2 | 10/1991 |
| JP | 2006-104951 | A | 4/2006 |
| JP | 2008-075645 | A | 4/2008 |

OTHER PUBLICATIONS

U.S. Appl. No. 12/195,897, filed Aug. 21, 2008, Kawakami.

H. Kawakami, U.S. PTO Notice of Allowance, U.S. Appl. No. 12/195,897, dated Nov. 23, 2011, 7 pages.

* cited by examiner

STEAM TURBINE HAVING A NOZZLE BOX ARRANGED AT AN UPSTREAM SIDE OF A STEAM PASSAGE THAT DIVIDES A SPACE BETWEEN A ROTOR AND A CASING INTO SPACES THAT ARE SEALED FROM EACH OTHER

CROSS REFERENCES TO RELATED APPLICATIONS

This application is based upon and claims the benefit of priority from the prior Japanese Patent Application No. 2007-215768, filed in the Japanese Patent Office on Aug. 22, 2007, the entire content of which is incorporated herein by reference.

BACKGROUND OF THE INVENTION

The present invention relates to a steam turbine and, more particularly, it relates to steam turbine designed to achieve a high efficiency by improving the nozzle box arrangement in the steam inlet section.

Generally, a steam turbine comprises a rotatable turbine rotor, moving blade stages, a casing and nozzle diaphragms. The casing and the nozzle diaphragms constitute as a stationary section. The rotor is rotatably provided in the casing. The nozzle diaphragms are arranged substantially coaxially with the turbine rotor, supported on the casing. The moving blade stages are provided on the turbine rotor so as to rotate together with the turbine rotor. Each of the moving blade stages comprises a plurality of moving blades arranged in the circumferential direction of the turbine rotor.

Each of the nozzle diaphragms comprises a plurality of turbine nozzles arranged in the circumferential direction relative to the turbine rotor and arranged at the upstream side of one of the moving blade stage. A pair of a nozzle diaphragm and a moving blade stage provided at the upstream side of the nozzle diaphragm forms a turbine stage. An ordinary steam turbine has a plurality of turbine stages.

More specifically, nozzle diaphragms, a turbine rotor and moving blade stages are substantially coaxially arranged in the casing. The steam led to a nozzle diaphragm passes through a plurality of turbine nozzles of the nozzle diaphragm and change its flowing direction. Then, the steam flowing out from the nozzle diaphragm is led to a moving blade portion of a moving blade stage that forms a pair with the nozzle diaphragm. The steam drives the moving blade stage and the turbine rotor as it passes between the plurality of moving blades of the moving blade stage.

As pointed out above, an ordinary steam turbine has a plurality of turbine stages. The steam that passes through one turbine stage is led to an adjacent turbine stage. More specifically, a plurality of moving blade stages are provided on the turbine rotor, separated from each other in the axial direction. The nozzle diaphragms are arranged in the casing so as to be placed between the moving blade stages in the axial direction of the turbine rotor. The moving blade portions of a plurality of moving blade stages and the turbine nozzle portions of a plurality of nozzle diaphragms form a steam passage.

Especially, for a high pressure turbine, a nozzle box is provided in the casing to lead the steam introduced in the casing to the turbine nozzles of the first stage, which constitute as a part of the steam passage. Known nozzle boxes include one described in Japanese Patent Application Laid-Open Publication No. 03-066484, the entire content of which is incorporated herein by reference.

Like the casing, the nozzle box constitutes as the stationary section. The nozzle box comprises a plurality of turbine nozzles of the first stage, which are arranged in the circumferential direction, provided at the outlet side of the nozzle box. In other words, the nozzle box and the nozzle diaphragm of the first stage (e.g. the first stage nozzle diaphragm) are arranged integrally and the steam introduced into the nozzle box is led to the steam passage, that includes the first moving blade stage that forms a pair with the first stage nozzle diaphragm provided with the nozzle box.

FIGS. 8 and 9 are schematic axial cross-sectional views of a known steam turbine having a nozzle box. FIG. 8 is a schematic axial cross-sectional view along a vertical direction and FIG. 9 is a schematic axial cross-sectional view along an angle inclined relative to the vertical direction by 45°.

The steam turbine 1 has a casing 2, a turbine rotor 3 rotatably arranged in the casing 2, a nozzle diaphragms 4*a*1, 4*a*2, 4*a*3, . . . that are rigidly secured to the casing 2. The casing 2 includes an outer casing 2*a* and an inner casing 2*b*.

A plurality of moving blade stages 3*a*1, 3*a*2, 3*a*3, . . . , are arranged on the turbine rotor 3, which is a rotating section of the steam turbine 1, in the axial direction from the upstream side to the downstream side. Each of the moving blade stages 3*a*1, 3*a*2, 3*a*3 has a plurality of moving blades, the plurality of moving blades of the moving blade stages being denoted respectively by 3*b*1, 3*b*2, 3*b*3, . . . , and rotating force is generated as steam flows, passing through the moving blades 3*b*1, 3*b*2, 3*b*3, . . . .

Nozzle diaphragms 4*a*1, 4*a*2, 4*a*3, . . . that are supported by the inner casing 2*b* are arranged between the moving blade stages 3*a*1, 3*a*2, 3*a*3, . . . such that they are substantially coaxial and separated from each other in the axial direction. A pair of the nozzle diaphragms 4*a*1, 4*a*2, 4*a*3, . . . and the moving blade stages 3*a*1, 3*a*2, 3*a*3, . . . , respectively, constitutes a turbine stage. A plurality of turbine nozzles 4*b*1, 4*b*2, 4*b*3, . . . are provided in the circumferential direction, respectively, with the nozzle diaphragms 4*a*1, 4*a*2, 4*a*3, . . . .

The nozzle diaphragms 4*a*1, 4*a*2, 4*a*3, . . . are supported by the casing 2 so as to constitute a stationary section of the steam turbine 1. The steam flow flowing through between the plurality of nozzle blades 4*b*1, 4*b*2, 4*b*3, . . . arranged in the circumferential direction is changed its flowing direction so as to be led to the moving blades 3*b*1, 3*b*2, 3*b*3, . . . of the moving blade stages 3*a*1, 3*a*2, 3*a*3, . . . of the pairs. The flow path of the steam including the portions of the turbine nozzles 4*b*1, 4*b*2, 4*b*3, . . . of the nozzle diaphragms 4*a*1, 4*a*2, 4*a*3, . . . and the portions of the moving blades 3*b*1, 3*b*2, 3*b*3, . . . of the moving blade stages 3*a*1, 3*a*2, 3*a*3 constitute as steam passage 8. The steam led to the steam turbine 1 flows through the steam passage 8 from an upstream side to a downstream side.

The steam turbine 1 is provided with a steam inlet pipe 7 and a nozzle box 5 that constitutes as members for introducing steam into the steam passage 8. The nozzle box 5 is a pressure vessel that deals with high temperature and high pressure steam. An inlet section of the nozzle box 5 is connected to the steam inlet pipe 7. A steam outlet section, namely, outlet section, of the nozzle box 5 is integrally provided with the first stage nozzle diaphragm 4*a*1 and the plurality of turbine nozzles 4*b*1 that are arranged in the circumferential direction.

The nozzle box 5 is rigidly secured to the casing 2 by a support member 6 arranged on the inner casing 2*b*. The plurality of first stage turbine nozzles 4*b*1, integrally arranged in the circumferential direction at the outlet section, serves as the first stage nozzle diaphragm 4*a*1. The nozzle box 5 is arranged substantially coaxial with the turbine rotor 3.

Thus, the steam flowed into the nozzle box 5 from the steam inlet pipe 7 is then led to the first stage nozzle diaphragm 4*a*1 that constitute as a part of steam passage 8. The steam led to the steam passage 8 expands as it passes through between the turbine nozzles 4*b*1, 4*b*2, 4*b*3, . . . and the moving blades 3*b*1, 3*b*2, 3*b*3, . . . and the thermal energy is converted into kinetic energy to drive the moving blade stages 3*a*1, 3*a*2, 3*a*3, . . . and the turbine rotor 3.

Note that the support member 6 is a member for supporting the nozzle box 5 in the inner casing 2*b*. The support member 6 is not arranged entirely along the nozzle box 5 in the circumferential direction as seen in FIG. 9.

The nozzle box 5 is arranged in a space formed between the inner casing 2*b* and the turbine rotor 3. The pressure of the space around the nozzle box 5 is substantially equal to the pressure of the steam passage 8 near the outlet of the first moving blade stage 3*a*1.

More particularly, in the steam turbine 1 as shown in FIG. 9, a part of the steam flowing out from the first stage nozzle diaphragm 4*a*1 of the nozzle box 5 does not flow along the steam passage 8 into the first moving blade stage 3*a*1, which outputs rotation energy converted from thermal energy. The steam, which does not flow along the steam passage 8 at the downstream side of the first stage nozzle diaphragm 4*a*1 of the nozzle box 5, leaks to the space around the nozzle box 5 and bypasses to the downstream side of the first moving blade stage 3*a*1 via an outer circumferential side of the nozzle box 5 (e.g. a space between the nozzle box 5 and the inner casing 2*b*), as indicated by dotted arrows in FIG. 9. This problem becomes particularly significant in a turbine having a large degree of reaction where the pressure difference between the outlet of the first stage turbine nozzles 4*b*1 and the outlet of the first moving blade stage 3*a*1 is large.

Additionally, in the known steam turbine 1, the pressure of the space around the nozzle box 5 is substantially equal to the pressure at the outlet of first moving blade stage 3*a*1, which has a large pressure difference with that of the steam flowing into the nozzle box 5. Therefore, when the steam conditions such as the temperature and the pressure of the steam flowing into the steam turbine 1 are raised in order to improve the efficiency of the steam turbine 1, further studies are necessary including the wall thickness of the nozzle box 5 and the materials suitable for the nozzle box 5 such as heat-resistant steel. The net result will be a raised cost of such a steam turbine 1.

BRIEF SUMMARY OF THE INVENTION

An object of the present invention is to provide a high performance steam turbine that can improve the efficiency of known steam turbine including the steam turbine having the nozzle box of above-mentioned structure.

According to the present invention, there is provided a steam turbine comprising: a stationary section that includes a casing; turbine rotor that includes a plurality of moving blade stages arranged in an axial direction, each of the moving blade stages being provided with a plurality of turbine moving blades arranged in a circumferential direction, and rotatably provided in the casing; a plurality of nozzle diaphragms, wherein each of the nozzle diaphragms having a plurality of turbine nozzles arranged in the circumferential direction, arranged substantially coaxially with the turbine rotor by being supported on the stationary section; a steam passage formed with moving blade portions of the plurality of moving blade stages and turbine nozzle portions of the plurality of nozzle diaphragms; a nozzle box supported on the stationary section, wherein the nozzle box is arranged at an upstream side of the steam passage substantially coaxially with the turbine rotor; and a sealing that divides a space between the turbine rotor and the casing into a first space provided at an inner side of the nozzle box and a second space provided at an outer side of the nozzle box.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Now, the present invention will be described in greater detail by referring to the accompanying drawings that illustrate preferred embodiments of the invention.

Figure 1:
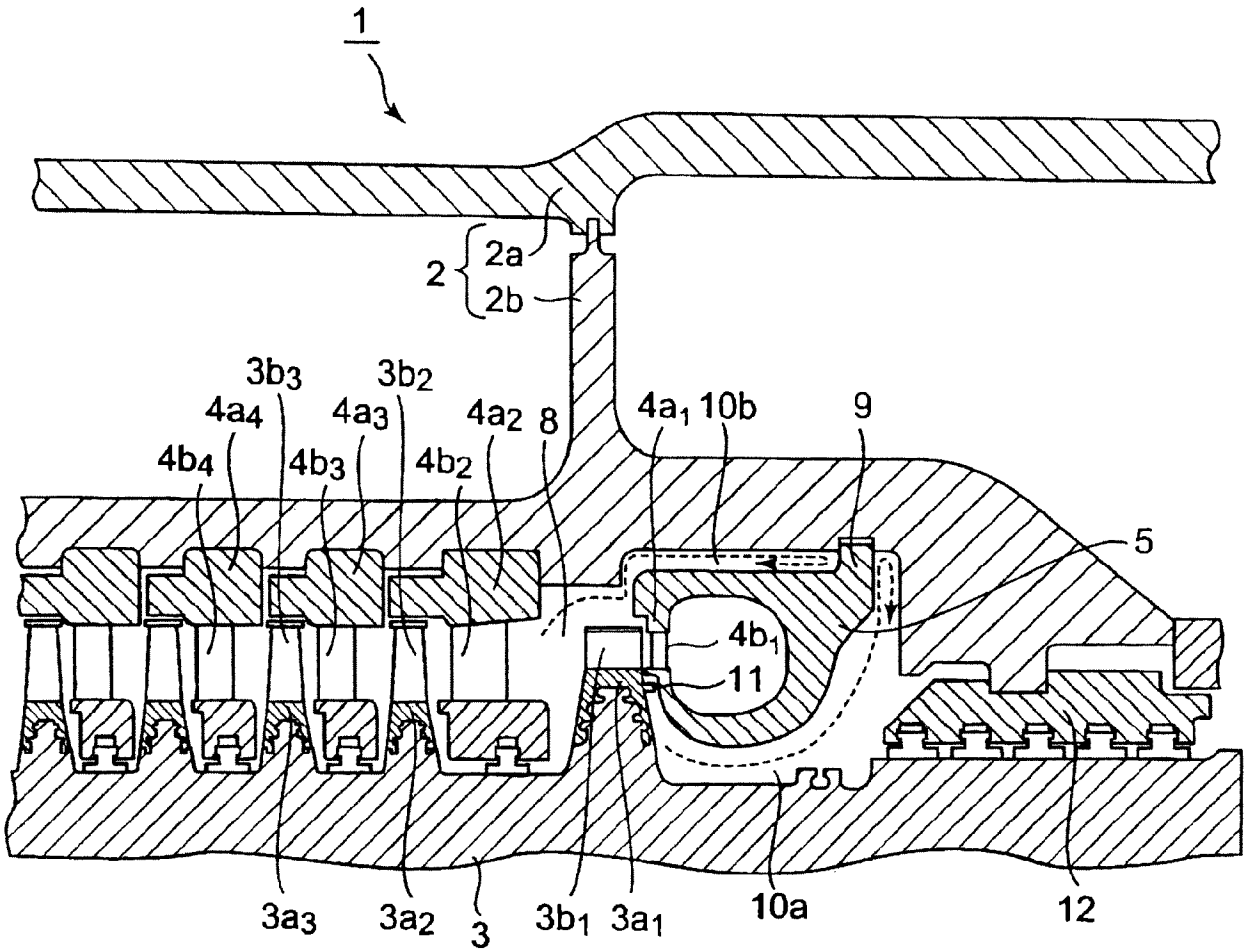
FIG. 1 is a schematic axial cross-sectional view of the first embodiment of steam turbine according to the present invention taken along a plane inclined by 45° from the vertical direction.
Figure 8:
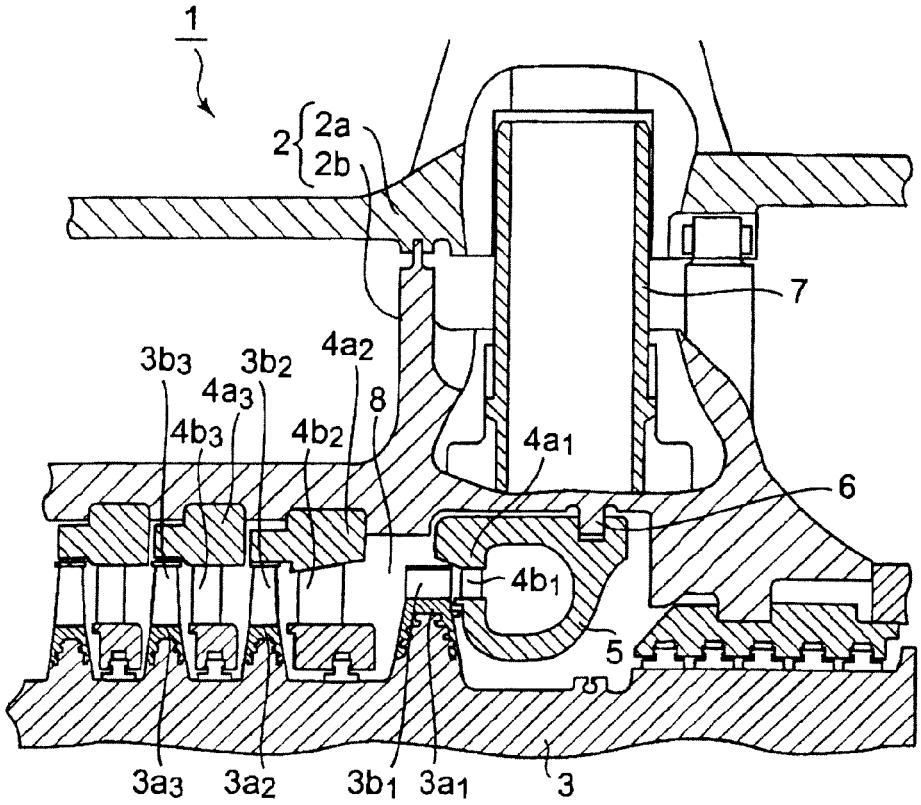
FIG. 8 PRIOR ART
FIG. 8 is a schematic axial cross-sectional view of a known steam turbine along a vertical direction.
Figure 9:
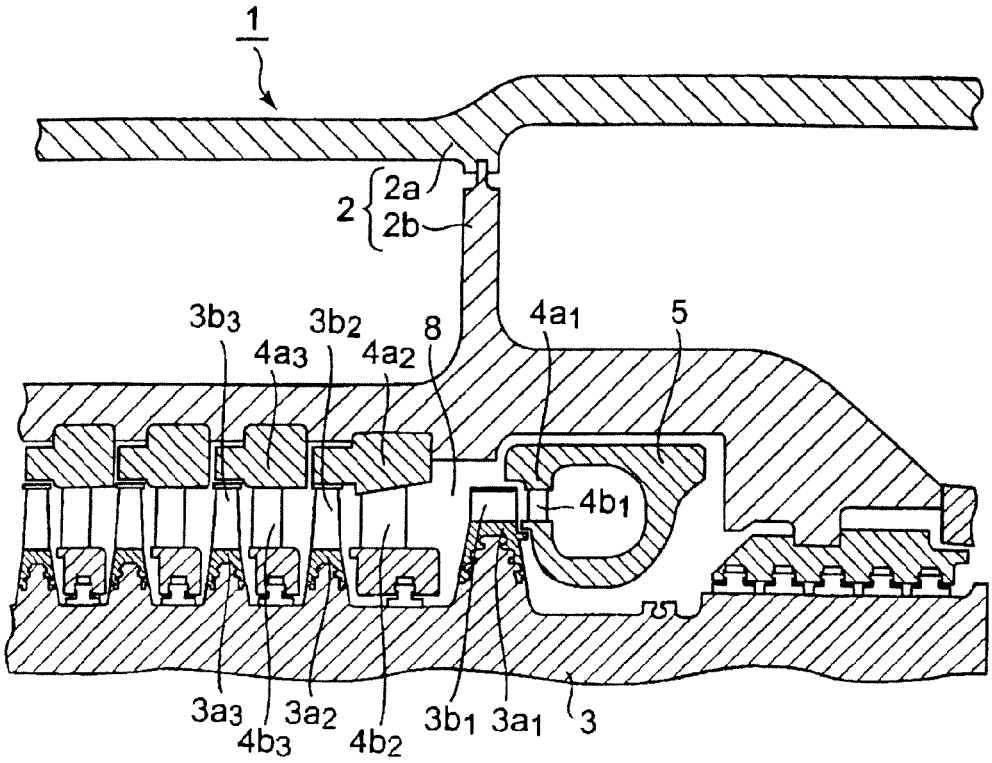
FIG. 9 PRIOR ART
FIG. 9 is a schematic axial cross-sectional view of the known steam turbine of FIG. 8 along a direction inclined by 45° as to a vertical direction.

FIG. 1 is a schematic axial cross-sectional view of the first embodiment of steam turbine according to the present invention, taken along a plane inclined by 45° from the vertical direction. In FIG. 1, the components same as those of the known steam turbine shown in FIGS. 8 and 9 are denoted respectively by the same reference symbols and will not be described any further unless necessary.

The steam turbine 1 of this embodiment has a casing 2, a turbine rotor 3 rotatably arranged in the casing 2 and nozzle diaphragms 4*a*1, 4*a*2, 4*a*3, . . . rigidly secured to the casing 2. The casing 2 includes an outer casing 2*a* and an inner casing 2*b*.

A plurality of moving blade stages 3*a*1, 3*a*2, 3*a*3, . . . are arranged on the turbine rotor 3, which is a rotating section of the steam turbine 1, in the axial direction from the upstream side to the downstream side. Each of the moving blade stages 3*a*1, 3*a*2, 3*a*3 has a plurality of moving blades, the plurality of moving blades of the moving blade stages being denoted respectively by 3b1, 3b2, 3b3, . . . , and rotating force is generated as steam flows, passing between the moving blades 3b1, 3b2, 3b3, . . . .

Nozzle diaphragms 4a1, 4a2, 4a3, . . . that are supported by the inner casing 2b are arranged between the moving blade stages 3a1, 3a2, 3a3, . . . such that they are substantially coaxial with the turbine rotor 3 and separated from each other in the axial direction. A pair of the nozzle diaphragms 4a1, 4a2, 4a3, . . . and the moving blade stages 3a1, 3a2, 3a3, . . . , respectively, constitutes a turbine stage. A plurality of turbine nozzles 4b1, 4b2, 4b3, . . . are provided in the circumferential direction, respectively with the nozzle diaphragms 4a1, 4a2, 4a3, . . . .

The nozzle diaphragms 4a1, 4a2, 4a3, . . . are supported by the inner casing 2 so as to constitute a stationary section of the steam turbine 1. The steam flow flowing through between the plurality of turbine nozzles 4b1, 4b2, 4b3, . . . arranged in the circumferential direction is changed its direction so as to be led to the moving blades 3b1, 3b2, 3b3, . . . of the moving blade stages 3a1, 3a2, 3a3, . . . of the pairs. The flow path of the steam including the portions of the turbine nozzles 4b1, 4b2, 4b3, . . . of the nozzle diaphragms 4a1, 4a2, 4a3, . . . and the portions of the moving blades 3b1, 3b2, 3b3, . . . of the moving blade stages 3a1, 3a2, 3a3 constitute as a steam passage 8. The steam led to the steam turbine 1 flows through the steam passage 8 from an upstream side to a downstream side.

A shaft sealing device 12 is provided between the turbine rotor 3 and the inner casing 2b so as to prevent steam in the vicinity of the turbine rotor 3 from leaking to the space outside the inner casing 2b. The shaft sealing device 12 comprises a main body and a plurality of packing heads that circumferentially engage with the main body.

The steam turbine 1 is provided with a nozzle box 5 that introduces steam into the steam passage 8. The nozzle box 5 is a pressure vessel that deals with high temperature and high pressure steam. Like the known steam turbine shown in FIG. 8, a steam inlet pipe (not shown) is connected to the steam inlet section of the nozzle box 5. At the outlet section of the nozzle box 5, namely a steam outlet section of the nozzle box 5, constitutes as part of the steam passage 8, a plurality of first stage turbine nozzles 4b1 are arranged in the circumferential direction. In other words, the first stage nozzle diaphragm 4a1 is structurally integrally provided at the outlet section of the nozzle box 5.

The nozzle box 5 is supported on the inner casing 2b substantially coaxial with the turbine rotor 3. A bulkhead 9, as a sealing, secures nozzle box 5 to the inner casing 2b. The bulkhead 9 is arranged between the nozzle box 5 and the inner casing 2b, which is a stationary section, along the entire circumferential direction of the nozzle box 5 so that a space between the turbine rotor 3 and the inner casing 2b is divided into two spaces including an inner space 10a that is located inside relative to the steam passage 8 and an outer space 10b that is located outside relative to the steam passage 8. The inner space 10a means a space including an inner peripheral side (inner side) of the nozzle box 5, and the outer space 10b means a space including at least an outer peripheral side (outer side) of the nozzle box. The outer peripheral side of the nozzle box 5 includes outer peripheral side of the steam passage 8. Steam is prevented from flowing from the inner space 10a to the outer space 10b and vice versa by the bulkhead 9 provided as the sealing between the nozzle box 5 and a stationary section other than the nozzle box 5.

Thus, the steam flowed into the nozzle box 5 is then led to the steam passage 8 from the outlet section of the nozzle box 5. The steam led to the steam passage 8 expands as it passes through between the turbine nozzles 4b1, 4b2, 4b3, . . . and the moving blades 3b1, 3b2, 3b3, . . . and converts its thermal energy into kinetic energy so as to drive the moving blade stages 3a1, 3a2, 3a3, . . . and the turbine rotor 3.

Having this bulkhead 9 as a sealing, the steam that flows out from the outlet section of the nozzle box 5 (e.g. the first stage nozzle diaphragm 4a1) does not bypass to the outlet side of the first moving blade stage 3a1 via the outer space 10b. Therefore, most of the steam flowing out from the first stage nozzle diaphragm 4a1 can be led to the first moving blade stage 3a1 along the steam passage 8. As a result, the thermal energy of the steam flowing out from the first stage nozzle diaphragm 4a1 can be efficiently converted into kinetic energy to improve the efficiency of the steam turbine 1.

Additionally, in this embodiment, an anti-leakage steam seal 11 is arranged between the first moving blade stage 3a1 and the nozzle box 5. With this arrangement, the flow of steam leaking out from the steam passage 8 between the outlet section of the nozzle box 5 and the adjacently located moving blade stage 3a1 can be reduced by the anti-leakage steam seal 11 to improve the performance of the steam turbine 1.

The bulkhead 9, which is a sealing, is integrally formed with the nozzle box 5 in this embodiment. However, it may alternatively be arranged integrally with the inner casing 2b or separately relative to the nozzle box 5 and the inner casing 2b as long as it is arranged between the nozzle box 5 and some other stationary section of the steam turbine 1 and can prevent the flow of steam between the inner space 10a and the outer space 10b.

Figure 2:
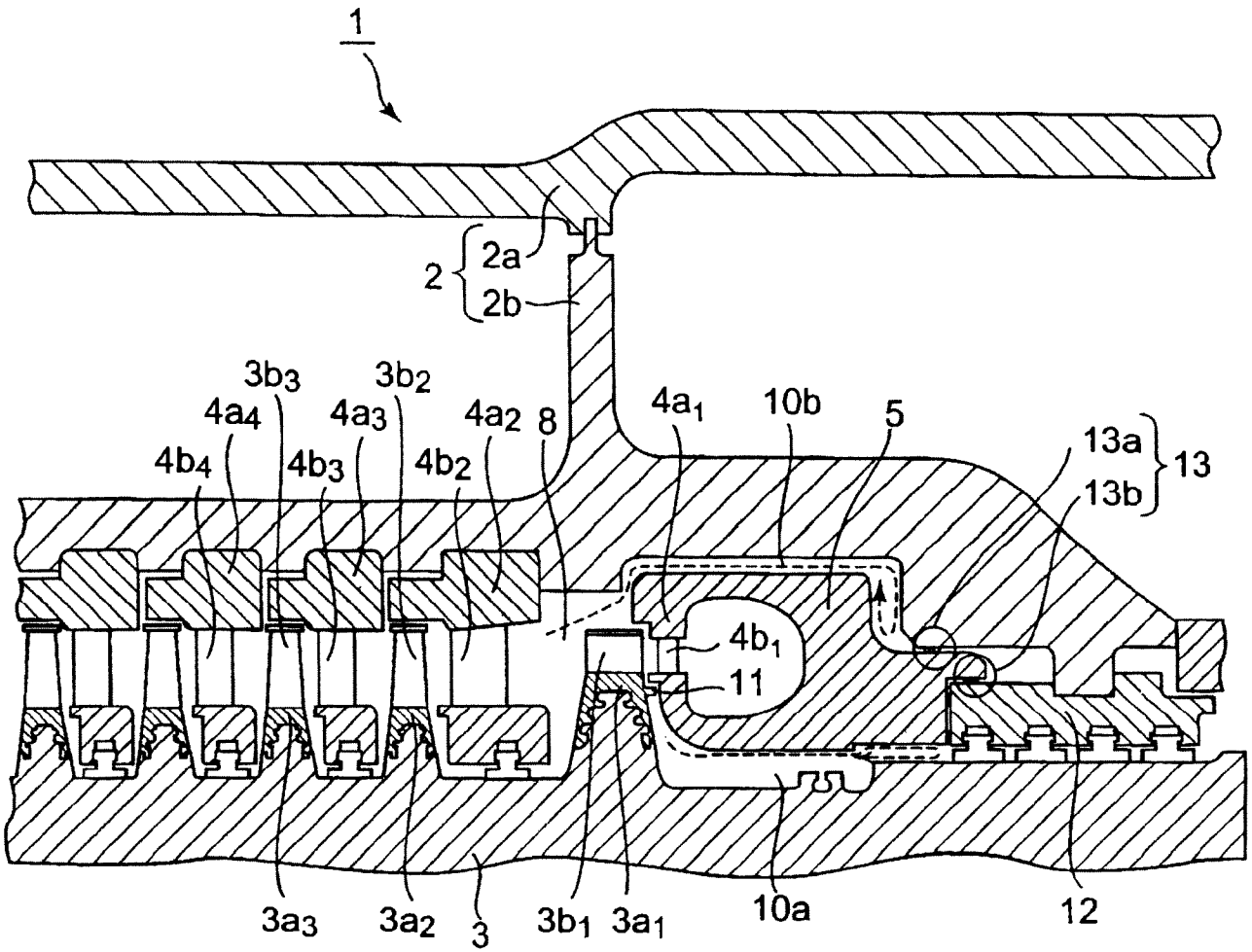
FIG. 2 is a schematic axial cross-sectional view of a modified embodiment of the first embodiment taken along a plane inclined by 45° from the vertical direction.
Figure 3:
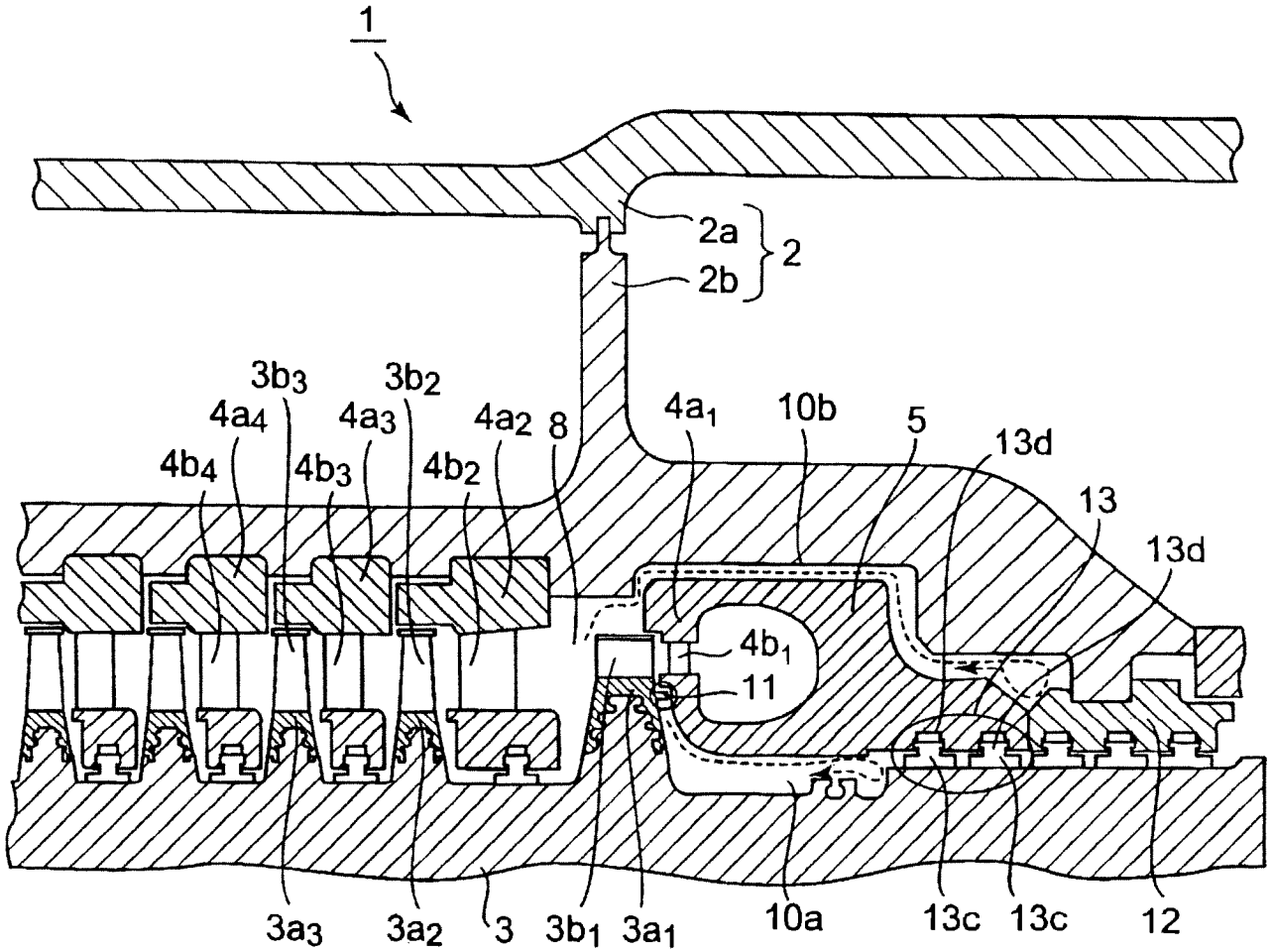
FIG. 3 is a schematic axial cross-sectional view of another modified embodiment of the first embodiment taken along a plane inclined by 45° from the vertical direction.

FIGS. 2 and 3 illustrate modified embodiments of this embodiment. FIGS. 2 and 3 are schematic axial cross-sectional views of the modified embodiments taken along a plane inclined by 45° from the vertical direction of the steam turbine. In FIGS. 2 and 3, the components same as those of the steam turbine of FIG. 1 are denoted respectively by the same reference symbols and will not be described in detail any further.

In these modified embodiments of steam turbine 1, the space formed around the nozzle box 5 between the turbine rotor 3 and the inner casing 2b is divided into two spaces including an inner space 10a that is located inside relative to the steam passage section 8 and an outer space 10b that is located outside relative to the steam passage section 8 by a sealing other than a bulkhead as shown in FIG. 1. Otherwise, the configuration of each of these modified embodiments is the same as that of the first embodiment shown in FIG. 1.

In the embodiment described in FIG. 1, the bulkhead 9 is provided as a sealing dividing the inner space 10a and the outer space 10b. In this modified embodiment, in contrast, a nozzle box sealing device 13 is provided as a sealing instead of the bulkhead 9 as shown in each of FIGS. 2 and 3. In other words, in each of the modified embodiments, the space formed around the nozzle box 5 between the turbine rotor 3 and the inner casing 2b is divided into two spaces including an inner space 10a that is located inside relative to the steam passage 8 and an outer space 10b that is located outside relative to the steam passage 8 by the nozzle box sealing device 13. The inner space 10a means a space including an inner peripheral side (inner side) of the nozzle box 5, and the outer space 10b means a space including at least an outer peripheral side (outer side) of the nozzle box. The outer peripheral side of the nozzle box 5 includes outer peripheral side of the steam passage 8.

Particularly, in modified embodiment shown in FIG. 2, the nozzle box sealing device 13 comprises a casing side sealing device 13a, which seals a gap between the nozzle box 5 and the inner casing 2b, and a rotor side sealing device 13b, which seals a gap between the nozzle box 5 and the shaft sealing device 12, in order to prevent steam flow flowing from the inner space 10*a* to the outer space 10*b* and vice versa. This arrangement provides advantages similar to those of the first embodiment of FIG. 1.

With another modified embodiment shown in FIG. 3, the nozzle box sealing device 13 comprises a packing head 13*c*, which seals a gap between the nozzle box 5 and the turbine rotor 3, and a groove section 13*d* circumferentially provided on an outer surface of the nozzle box 5 facing to the turbine rotor 3. The packing head 13*c* comprises a plurality of segments arranged in the circumferential direction inserted into the groove section 13*d* of the nozzle box 5 for engagement, so that as a whole the gap between the nozzle box 5 and the turbine rotor 3 is sealed along the entire periphery of the turbine rotor 3.

With this arrangement, the maintainability of the packing head 13*c* is improved, so that the packing head 13*c* can be readily replaced by new ones when steam leaks due to degradation of the packing head 13*c* occurs. The modified embodiment of FIG. 3 has two nozzle box sealing devices 13, each having a packing head 13*c* and a groove section 13*d*, that are arranged in series in the axial direction. However, the number of nozzle box sealing devices 13 may be one or more than two appropriately depending on the required pressure difference between the inner space 10*a* and the outer space 10*b*.

Now, the steam turbine of the second embodiment will be described below by referring to FIG. 4.

Figure 4:
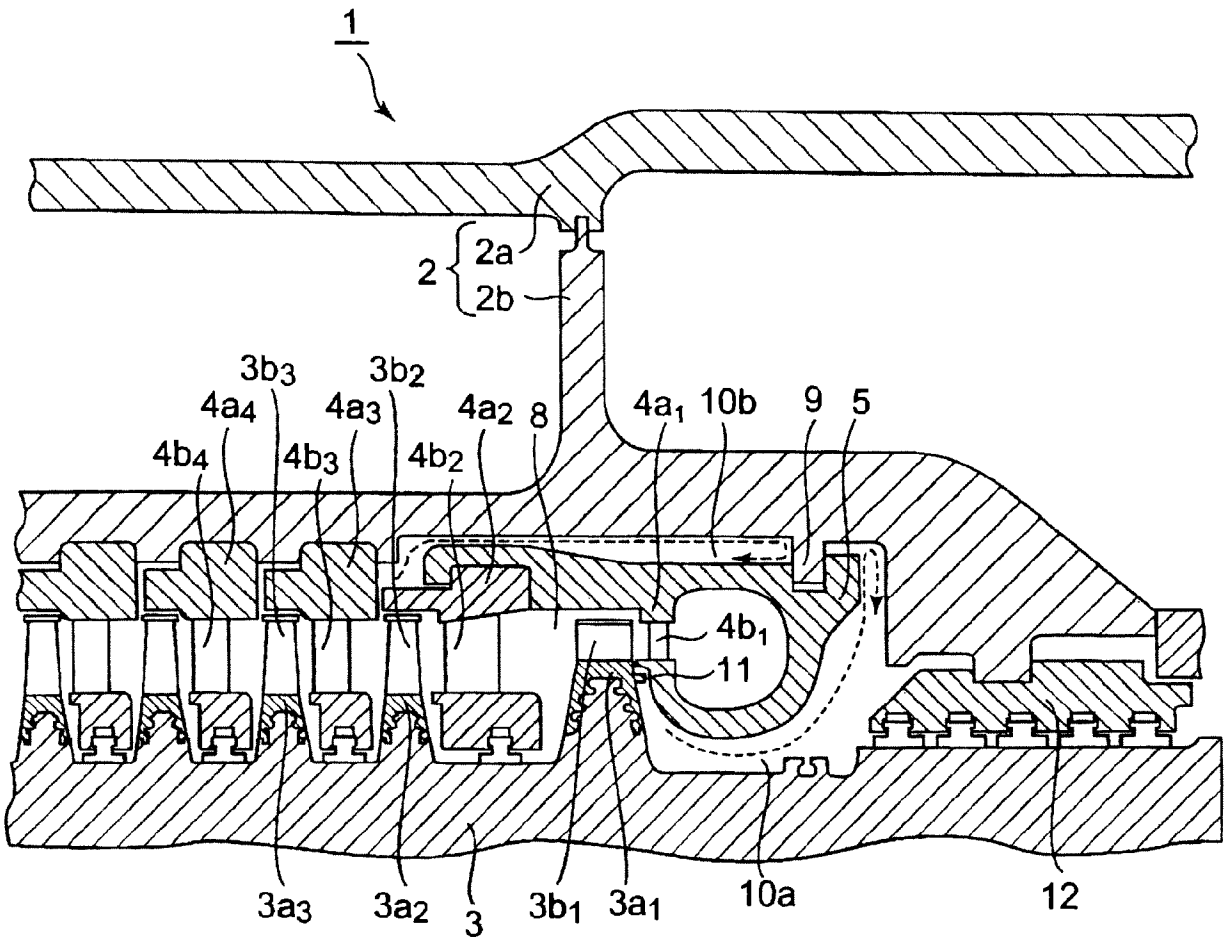
FIG. 4 is a schematic axial cross-sectional view of the second embodiment of steam turbine according to the present invention taken along a plane inclined by 45° from the vertical direction.

FIG. 4 is a schematic axial cross-sectional view of the second embodiment of steam turbine according to the present invention taken along a plane inclined by 45° from the vertical direction. In FIG. 4, the components same as those of the steam turbine of FIG. 1 are denoted respectively by the same reference symbols and will not be described in detail any further.

The nozzle box 5 is integrally provided with the first stage nozzle diaphragm 4*a*1 and the nozzle box 5 holds the first stage turbine nozzles 4*b*1 in the steam turbine of the first embodiment. In this second embodiment, the nozzle box 5 holds not only the first stage turbine nozzles 4*b*1 but also at least another stage of turbine nozzles, the second stage turbine nozzles 4*b*2 for instance.

More specifically, in this embodiment as shown in FIG. 4, the outer peripheral side member of the nozzle box 5 extends to the downstream side in the axial direction. A hook section is provided at the extended portion (e.g. the outer peripheral side member of the nozzle box 5 extended to the downstream side in the axial direction). The second stage nozzle diaphragm 4*a*2 engages with the hook section. A plurality of second stage turbine nozzles 4*b*2 are arranged in the circumferential direction on the second stage nozzle diaphragm 4*a*2. Thus, the second stage turbine nozzles 4*b*2 are secured to the nozzle box 5 having the second stage nozzle diaphragm 4*a*2 therebetween. Otherwise, this embodiment is same as the first embodiment. Note that the bulkhead 9 separating the inner space 10*a* and the outer space 10*b* is integrally formed with the inner casing 2*b*.

The second stage nozzle diaphragm 4*a*2 that supports the second stage turbine nozzles 4*b*2 is arranged separately with the nozzle box 5 in FIG. 4. Alternatively, the second stage nozzle diaphragm 4*a*2 may be arranged integrally with the nozzle box 5 like the first stage nozzle diaphragm 4*a*1.

With this arrangement, the pressure of the outer space 10*b* of the space around the nozzle box 5 is substantially equal to the pressure of the steam passage 8 at the outlet of the second moving blade stage 3*a*2. As a result, the pressure of the outer space 10*b* can be further reduced so that the wall thickness of the inner casing 2*b* can be reduced.

Additionally, since the space around the nozzle box 5 is divided into the outer space 10*b* and the inner space 10*a* by the bulkhead 9, the steam flowing out from the turbine nozzles 4*b*1 of the first stage nozzle diaphragm 4*a*1 would not bypass through the space around the nozzle box 5 and flow out along the steam passage 8 so that the steam turbine of this embodiment can achieve a high efficiency.

This embodiment can be modified in various different ways like the first embodiment. Modified embodiments of the second embodiment will be described below by referring to FIGS. 5 through 7.

Figure 5:
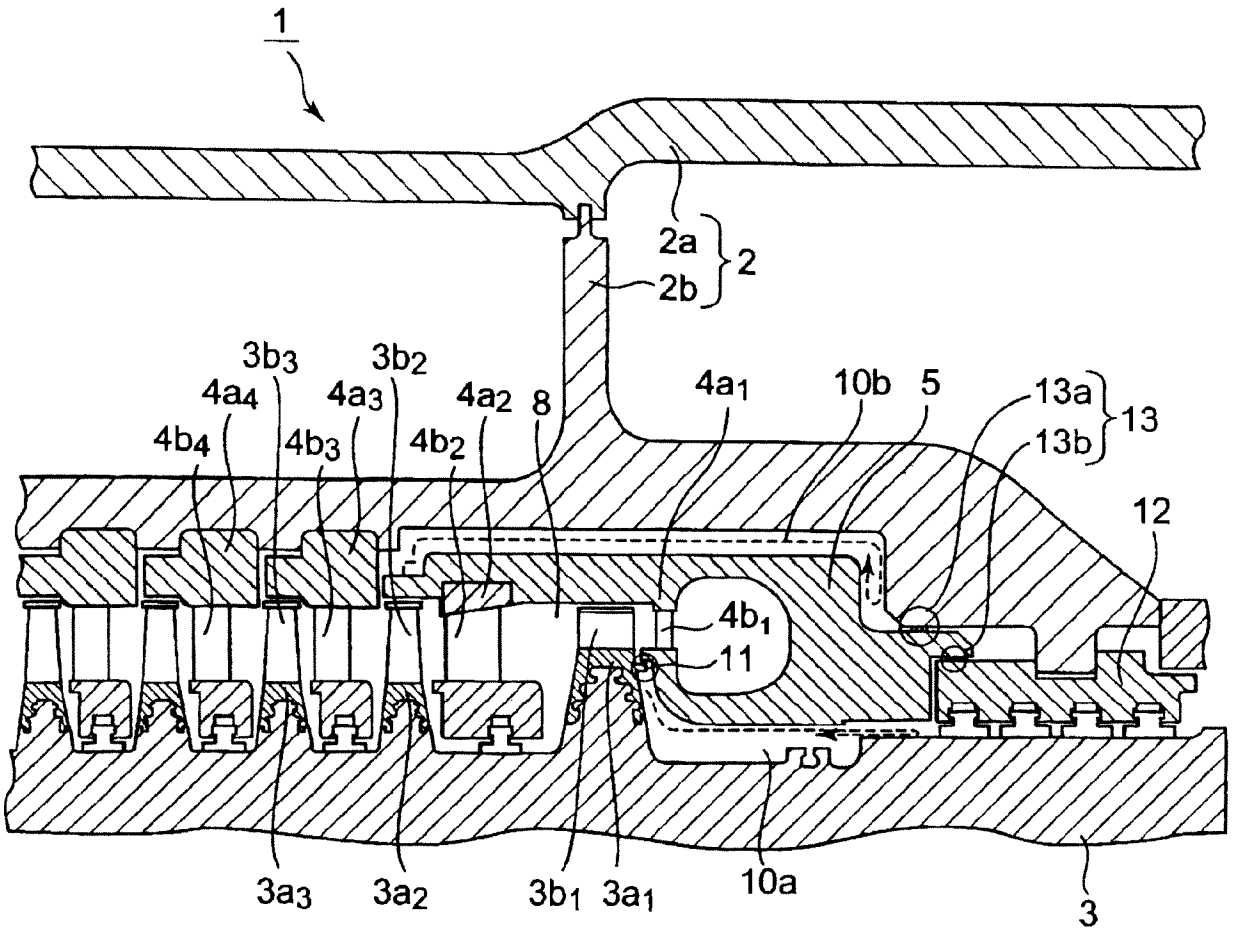
FIG. 5 is a schematic axial cross-sectional view of a modified embodiment of the second embodiment taken along a plane inclined by 45° from the vertical direction.
Figure 6:
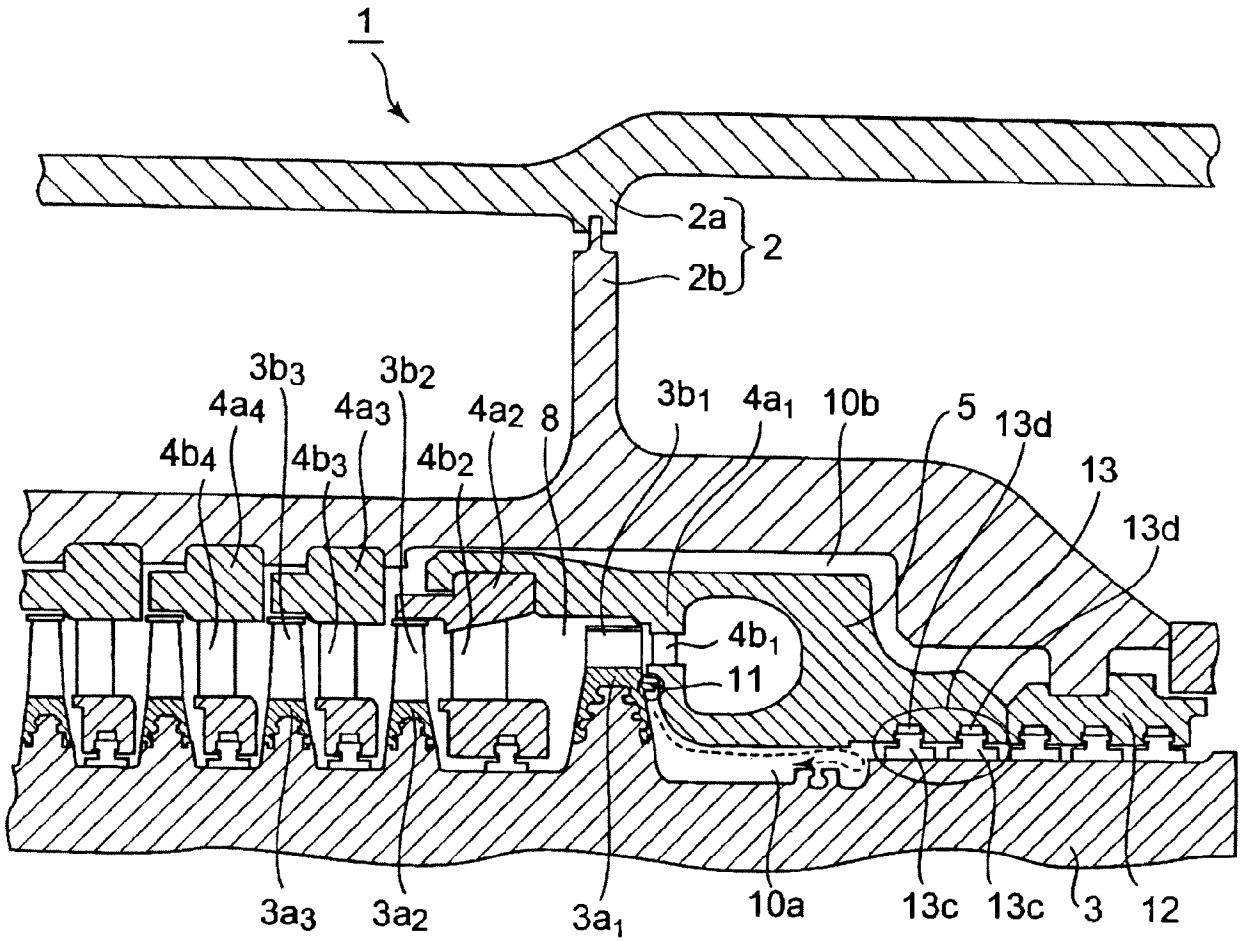
FIG. 6 is a schematic axial cross-sectional view of another modified embodiment of the second embodiment taken along a plane inclined by 45° from the vertical direction.
Figure 7:
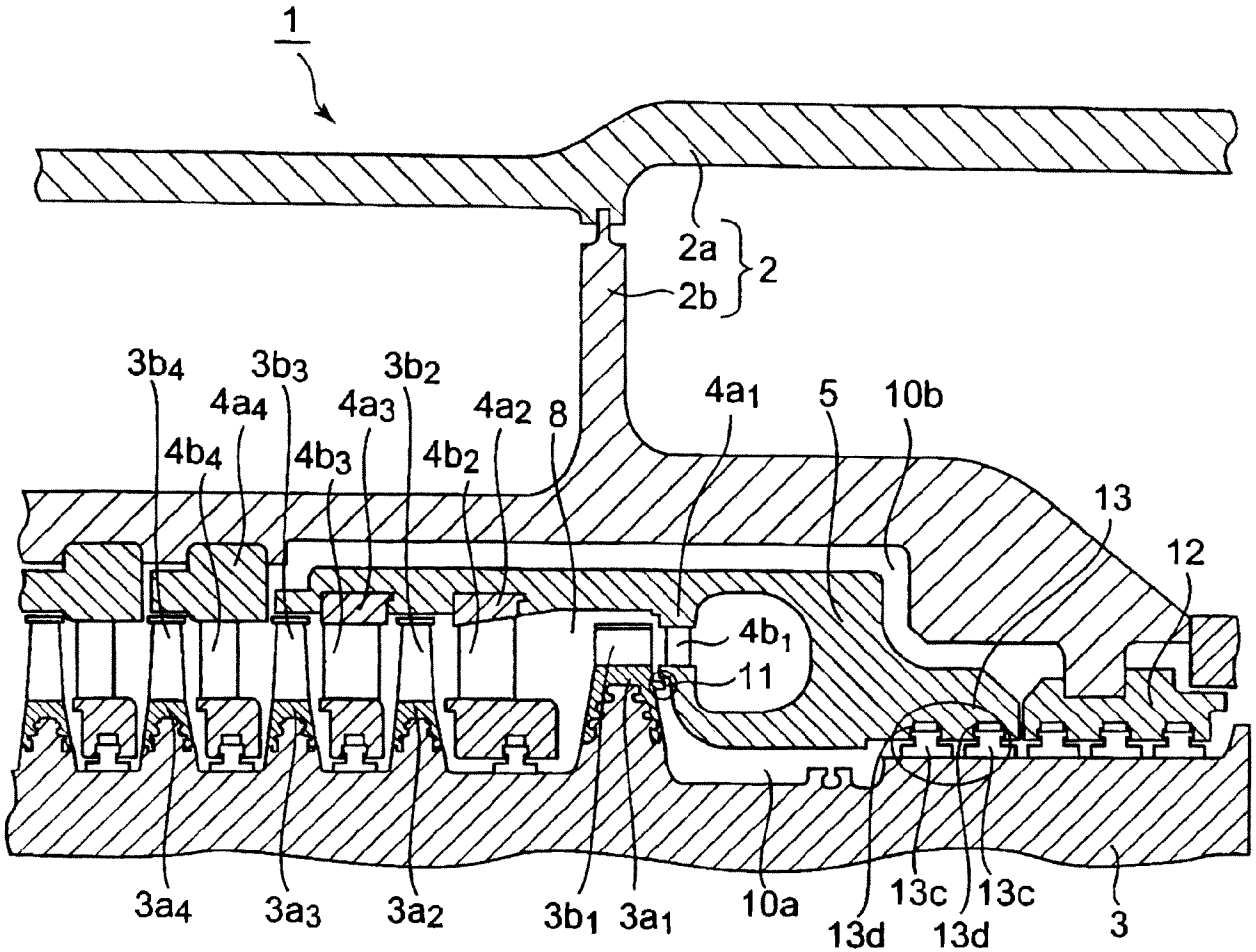
FIG. 7 is a schematic axial cross-sectional view of still another modified embodiment of the second embodiment taken along a plane inclined by 45° from the vertical direction.

FIGS. 5 through 7 are schematic axial cross-sectional views of the modified embodiments of the second embodiment taken along a plane inclined by 45° from the vertical direction. In FIGS. 5 through 7, the components same as those of the steam turbines of FIGS. 1 through 4 are denoted respectively by the same reference symbols and will not be described in detail any further.

In each of the modified embodiments shown in FIGS. 5 and 6, the bulkhead 9 for dividing the space around the nozzle box 5 into an inner space 10*a* and an outer space 10*b* as shown in FIG. 4 is replaced by a nozzle box sealing device 13. Otherwise, the modified embodiments are the same as the second embodiment shown in FIG. 4.

In the modified embodiment shown in FIG. 5, the nozzle box sealing device 13 comprises a casing side sealing device 13*a*, which seals a gap between the nozzle box 5 and the inner casing 2*b*, and a rotor side sealing device 13*b*, which seals a gap between the nozzle box 5 and the main body of the shaft sealing device 12 like the modified embodiment of the first embodiment shown in FIG. 2.

In the modified embodiment shown in FIG. 6, the nozzle box sealing device 13 comprises a packing head 13*c*, which seals a gap between the nozzle box 5 and the turbine rotor 3, and a groove section 13*d* circumferentially provided on an outer surface of the nozzle box 5 facing to the turbine rotor 3. In the modified embodiment shown in FIG. 6, like in the modified embodiment of the first embodiment shown in FIG. 3, the packing head 13*c* comprises a plurality of segments arranged in the circumferential direction inserted into the groove section 13*d* of the nozzle box 5 for engagement, so that as a whole the gap between the nozzle box 5 and the turbine rotor 3 is sealed along the entire periphery of the turbine rotor 3. The modified embodiment of FIG. 6 also has two nozzle box sealing devices 13, each having a packing head 13*c* and a groove section 13*d*, that are arranged in series in the axial direction. However, the number of nozzle box sealing devices may be selected appropriately depending on the design conditions and other factors.

The modified embodiment shown in FIG. 7 is a further modification of the modified embodiment shown in FIG. 6. In the second embodiment and its modified embodiments shown in FIGS. 4 through 6, the nozzle box 5 holds the first stage turbine nozzles 4*b*1 and the second stage turbine nozzles 4*b*2. On the other hand, in the modified embodiment shown in FIG. 7, the nozzle box 5 further holds the third stage turbine nozzles 4*b*3.

More specifically, as shown in FIG. 7, the outer peripheral side member of the nozzle box 5 extends to the downstream side in the axial direction. Two hook sections are provided at the extended portion and the second stage nozzle diaphragm 4*a*2 and the third stage nozzle diaphragm 4*a*3 are engaged respectively with the two hook sections. A plurality of second stage turbine nozzles 4*b*2 and a plurality of third stage turbine nozzles 4*b*3 are circumferentially provided respectively with the second stage nozzle diaphragm 4*a*2 and the third stage nozzle diaphragm 4*a*3. Thus, in this modified embodiment, the second stage turbine nozzles 4*b*2 and the third stage turbine nozzles 4*b*3 are secured to the nozzle box 5 respectively, having the second stage nozzle diaphragm 4*a*2 and the third stage nozzle diaphragm 4*a*3 therebetween. Otherwise, the configuration of this modified embodiment is the same as that of the modified embodiment of the second embodiment shown in FIG. 6.

With this arrangement, the pressure of the outer space 10*b* of the space around the nozzle box 5 is substantially equal to the pressure of the steam passage section 8 at the outlet of the third moving blade stage 3*a*3. As a result, the pressure of the outer space 10*b* can be further reduced so that the wall thickness of the inner casing 2*b* can be reduced accordingly.

In this modified embodiment shown in FIG. 7, the second and third stage nozzle diaphragms 4*a*2, 4*a*3 are arranged separately with the nozzle box 5 and the second stage and third stage turbine nozzles 4*b*2, 4*b*3 are held by the nozzle box 5 respectively by having the nozzle diaphragms 4*a*2, 4*a*3 therebetween. The arrangement is not limited thereto and the second stage and third stage nozzle diaphragms 4*a*2, 4*a*3 may be integrally formed with the outer peripheral member of the nozzle box 5 extended to the downstream side in the axial direction.

The first through third stage turbine nozzles 4*b*1, 4*b*2, 4*b*3 are held by the nozzle box 5 in the modified embodiment shown in FIG. 7. The fourth and the subsequent turbine nozzles 4*b*4, . . . may also be held by the nozzle box 5.

The nozzle box sealing device 13 including the packing head 13*c* and the groove section 13*d* is provided as a sealing for dividing the space around the nozzle box 5 into the inner space 10*a* and the outer space 10*b* in the modified embodiment of FIG. 7. However, the nozzle box sealing device 13 may be two members including a casing side sealing device 13*a*, which seals a gap between the nozzle box 5 and the inner casing 2*b* and a rotor side sealing device 13*b*, which seals a gap between the nozzle box 5 and the main body of the shaft sealing device 12 as shown in FIG. 2 or FIG. 5. Alternatively, the nozzle box sealing device 13 may be replaced by a bulkhead 9 as shown in FIG. 1 or FIG. 4.

What is claimed is:

1. A steam turbine comprising:

a stationary section that includes a casing;

a turbine rotor that includes a plurality of moving blade stages arranged in an axial direction, each of the moving blade stages being provided with a plurality of moving blades arranged in a circumferential direction, and rotatable provided in the casing;

a plurality of nozzle diaphragms, wherein each of the nozzle diaphragms having a plurality of turbine nozzles arranged in the circumferential direction, arranged substantially coaxially with the turbine rotor by being supported on the stationary section;

a steam passage formed with moving blade portions of the plurality of moving blade stages and turbine nozzle portions of the plurality of nozzle diaphragms;

a nozzle box supported on the stationary section, wherein the nozzle box is arranged at an upstream side of the steam passage substantially coaxially with the turbine rotor; and a sealing that divides a space between the turbine rotor and the casing into a first space provided at an inner side of the nozzle box and a second space provided at an outer side of the nozzle box, the sealing being a bulkhead arranged between the nozzle box and the casing along an entire circumferential direction of the nozzle box.

2. The steam turbine according to claim 1, wherein the sealing is arranged between the nozzle box and the stationary section.

3. The steam turbine according to claim 1, further comprising a second sealing provided in the first space near a steam outlet of the nozzle box to prevent steam flow in the steam passage from leaking out from the steam passage.

4. The steam turbine according to claim 1, wherein the nozzle box further comprises at least two nozzle diaphragms provided at a side of a steam outlet of the nozzle box.

* * * * *